US007637507B2

(12) United States Patent
Peck et al.

(10) Patent No.: US 7,637,507 B2
(45) Date of Patent: Dec. 29, 2009

(54) SKILL CRANES AND OTHER AMUSEMENT VENDING MACHINES HAVING VISUAL TARGETING SYSTEMS

(75) Inventors: Daniel W. Peck, Golden, CO (US); James R. Staffa, Lafayette, CO (US)

(73) Assignee: Coinstar Entertainment Services, Inc., Louisville, CO (US)

( * ) Notice: Subject to any disclaimer, the term of this patent is extended or adjusted under 35 U.S.C. 154(b) by 207 days.

(21) Appl. No.: 11/282,412

(22) Filed: Nov. 18, 2005

(65) Prior Publication Data

US 2007/0114725 A1 May 24, 2007

(51) Int. Cl.
*A63F 9/00* (2006.01)

(52) U.S. Cl. ..... 273/448

(58) Field of Classification Search ..... 273/440, 273/447, 448

See application file for complete search history.

(56) References Cited

U.S. PATENT DOCUMENTS

| | | | | |
|---|---|---|---|---|
| 4,460,855 | A | 7/1984 | Kelly et al. | |
| 4,684,128 | A | 8/1987 | Verstraeten et al. | |
| 4,718,667 | A | 1/1988 | Shoemaker, Jr. | |
| 5,271,628 | A | 12/1993 | Okada et al. | |
| 5,397,134 | A | 3/1995 | Fishman et al. | |
| 5,415,417 | A | 5/1995 | Reis, Jr. | |
| 5,511,794 | A | 4/1996 | Katamoto et al. | |
| 5,549,372 | A | 8/1996 | Lewis | |
| 5,711,530 | A | 1/1998 | Lewis | |
| 6,139,429 | A | 10/2000 | Shoemaker, Jr. | |
| 6,152,447 | A | 11/2000 | Stanley et al. | |
| 6,234,487 | B1 * | 5/2001 | Shoemaker, Jr. | 273/447 |
| 6,283,475 | B1 | 9/2001 | Stubben | |
| 6,336,636 | B1 | 1/2002 | Smart | |
| 6,475,087 | B1 | 11/2002 | Cole | |
| 6,588,760 | B2 * | 7/2003 | Carter et al. | 273/448 |
| 6,899,337 | B2 * | 5/2005 | Fisher et al. | 273/447 |

(Continued)

FOREIGN PATENT DOCUMENTS

| | | | |
|---|---|---|---|
| JP | 11319305 A | * | 11/1999 |
| KR | 383064 B | * | 5/2003 |

OTHER PUBLICATIONS

U.S. Appl. No. 11/009,371, Richards.

(Continued)

*Primary Examiner*—Raleigh W. Chiu
(74) *Attorney, Agent, or Firm*—McDonald Hopkins LLC

(57) ABSTRACT

Laser-based and non-laser-based visual targeting systems for use with skill cranes and other amusement vending machines are disclosed herein. In one embodiment, an amusement vending machine includes a see-through enclosure containing at least one prize. A user-operable controller, such as a joystick, positioned on the outside of the enclosure is operably connected to a pick-up device, such as a claw, positioned within the enclosure. Selective operation of the controller causes the pick-up device to move within the enclosure and perform a prize pick-up maneuver. In one aspect of this embodiment, the amusement machine further includes a visual targeting system that provides a visual indication of the position of the pick-up device relative to the prize to assist the player in positioning the pick-up device before attempting the prize pick-up maneuver.

26 Claims, 5 Drawing Sheets

U.S. PATENT DOCUMENTS

| | | | | |
|---|---|---|---|---|
| 6,921,076 | B1 | 7/2005 | Norton | |
| 6,957,813 | B2 | 10/2005 | Verstraeten et al. | |
| 2005/0218602 | A1* | 10/2005 | Watanabe et al. | 273/447 |
| 2006/0094489 | A1* | 5/2006 | Fukazawa et al. | 463/7 |
| 2006/0170164 | A1* | 8/2006 | Watanabe | 273/447 |
| 2007/0029734 | A1* | 2/2007 | Fukazawa et al. | 273/447 |
| 2007/0114725 | A1* | 5/2007 | Peck et al. | 273/447 |

OTHER PUBLICATIONS

Smart Industries Corp. Mfg., "Laser Crane 42"," Des Moines, IA, 4 pages http:/www.smartind.com/pages/42laser.html [accessed Mar. 17, 2006].

Smart Industries Corp. Mfg., "Laser Crane 42"," Des Moines, IA, 4 pages http:/www.smartind.com/pages/42laser.html, Patent Pending Version [accessed Dec. 11, 2006].

* cited by examiner

SKILL CRANES AND OTHER AMUSEMENT VENDING MACHINES HAVING VISUAL TARGETING SYSTEMS

TECHNICAL FIELD

The following disclosure relates generally to amusement vending machines and, more particularly, to amusement vending machines having visual targeting systems.

BACKGROUND

Skill cranes and other amusement vending machines are typically found in retail locations where children are present. Such locations often include grocery stores, theme restaurants, game arcades, and the like. U.S. Pat. Nos. 4,718,667 and 5,711,530 describe conventional skill crane games in detail. Other skill cranes and related systems are disclosed in pending U.S. patent application Ser. No. 11/009,371, which was filed on Dec. 10, 2004, and is entitled "SYSTEMS AND METHODS FOR COLLECTING VEND DATA FROM, AND EXCHANGING INFORMATION WITH, VENDING MACHINES AND OTHER DEVICES." U.S. Pat. Nos. 4,718,667 and 5,711,530, and U.S. patent application Ser. No. 11/009,371, are incorporated in the present patent application in their entireties by reference.

Conventional skill crane games typically include a transparent cabinet that holds a plurality of prizes, such as stuffed toy animals, capsulated items, candy, etc. A movable claw or other grasping device is positioned inside the cabinet, and is operably connected to a joystick mounted on the outside of the cabinet. After inserting the required amount of money, the player attempts to grab a prize by moving the open claw into position with the joystick and releasing it. If the player has skillfully positioned the claw over the desired toy or prize, then the claw will descend onto the toy and grasp it. The claw then transfers the toy to an outlet chute from which the player can retrieve the toy. With all the toys mixed together in a pile, however, it is often difficult for the player to determine exactly which toy the claw is hovering over before dropping the claw. As a result, the player is often unsuccessful at grabbing a toy.

Some skill crane games limit the amount of time the player has to grab a prize. If the player does not grab a prize in the given time, then the player must insert more money into the machine for continued play. Other skill crane games give the player a single opportunity to drop the claws over a desired toy in an attempt to grasp a prize. If the player is unsuccessful, then the player must insert additional money for continued attempts. Given the difficulty of grabbing a toy on the first or second try, many players become discouraged by these game formats and do not return to play the game again.

SUMMARY

This summary is provided for the benefit of the reader only, and is not intended to limit the invention as set forth by the claims.

The present invention is directed generally to skill game vending machines having visual targeting systems. An amusement vending machine configured in accordance with one aspect of the invention includes an enclosure having a transparent portion, and at least one prize positioned within the enclosure. The amusement vending machine further includes a user-operable prize selecting device movably positioned within the enclosure, and a laser operably coupled to the prize selecting device. The laser can provide a visual indication of the position of the prize selecting device relative to the prize. In one embodiment, for example, the laser can provide a visual indication of the vertical alignment of the prize selecting device relative to the prize. In another embodiment, the laser can project an image onto the prize to assist in the alignment of the prize selecting device relative to the prize.

A method of providing entertainment in accordance with another aspect of the invention includes providing a vending machine having a user-operable pick-up device for retrieving a prize, and receiving payment from a user for use of the vending machine. The method can further include allowing the user to maneuver the pick-up device and at least attempt to pick up the prize in response to receiving payment from the user. The method can additionally include providing a visual reference that assists the user in positioning the pick-up device relative to the prize. In one embodiment, providing a visual reference includes attaching a laser to the user-operable pick-up device to assist the user in positioning the pick-up device relative to the prize.

DETAILED DESCRIPTION

The following disclosure describes laser-based and non-laser-based visual targeting systems for use with skill cranes and other amusement vending machines. Certain details are set forth in the following description to provide a thorough understanding of various embodiments of the invention. Other details describing well-known structures and systems often associated with skill cranes and other amusement vending machines are not set forth below, however, to avoid unnecessarily obscuring the description of the various embodiments of the invention.

Many of the details, dimensions, angles and other features shown in the Figures are merely illustrative of particular embodiments of the invention. Accordingly, other embodiments can have other details, dimensions, angles and features without departing from the spirit or scope of the present invention. Furthermore, additional embodiments of the invention can be practiced without several of the details described below.

In the Figures, identical reference numbers identify identical or at least generally similar elements. To facilitate the discussion of any particular element, the most significant digit or digits of any reference number refer to the Figure in which that element is first introduced. For example, element 110 is first introduced and discussed with reference to FIG. 1.

Figure 1:
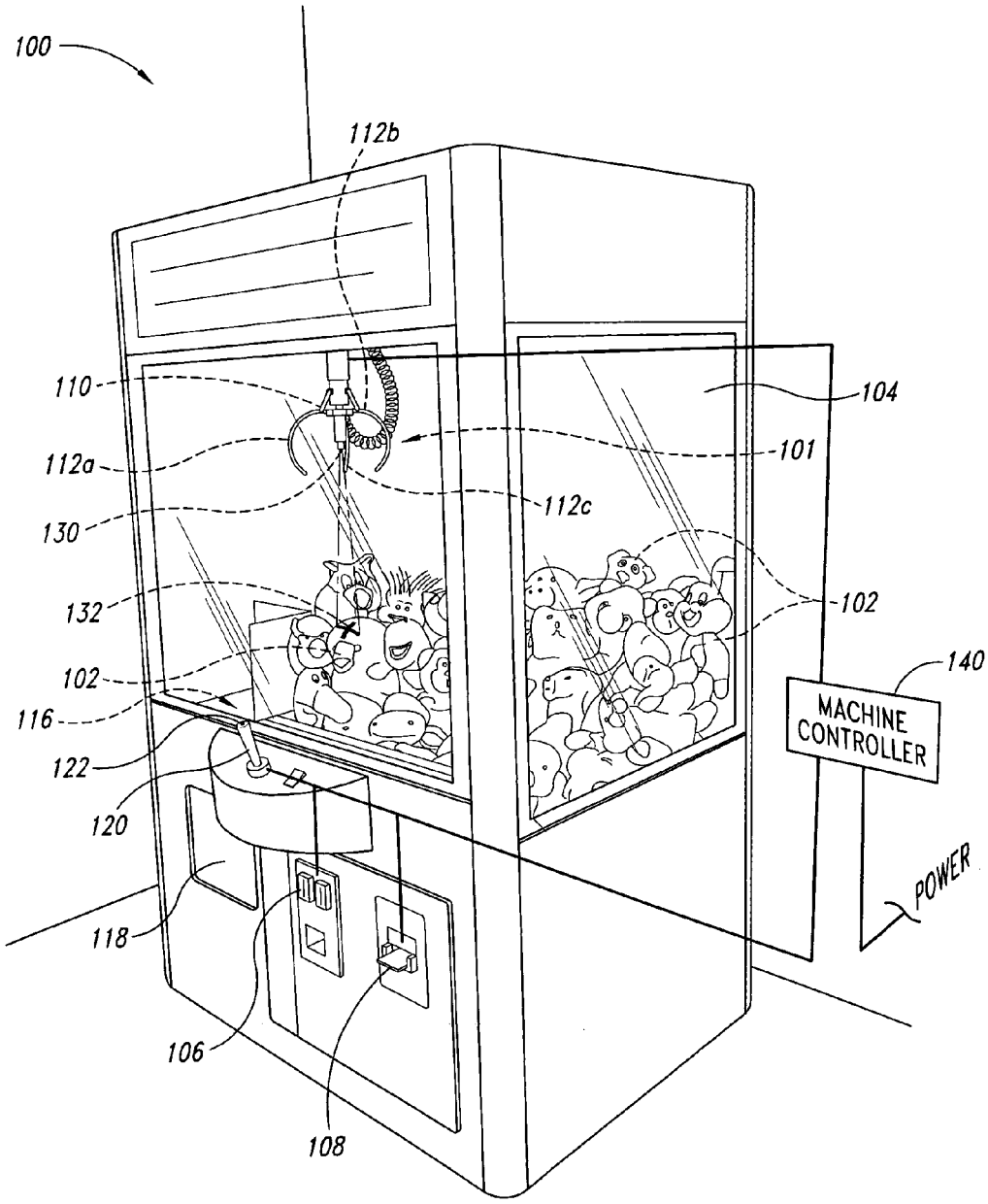
FIG. 1 is a partially schematic isometric view of an amusement vending machine configured in accordance with an embodiment of the invention.

FIG. 1 is a partially schematic isometric view of a skill crane vending machine 100 having a visual targeting system 130 configured in accordance with an embodiment of the invention. In one aspect of this embodiment, the skill crane vending machine 100 ("vending machine 100") holds a plurality of prizes 102 (e.g., a plurality of stuffed toy animals, capsulated items, jewelry, watches, candy, etc.) in a see-through enclosure 104. A prize selecting device 101 is positioned within the enclosure 104 and is operably connected to a controller or joystick 120. In the illustrated embodiment, the prize selecting device 101 includes a claw 110 for picking up one or more of the prizes 102. In other embodiments, however, the prize selecting device 101 can include other types of devices for picking things up including, for example, magnets, hooks, scoops, suction-cups, etc. In further embodiments described in greater detail below, the prize selecting device 101 can be configured to release "pucks" or other items that are dropped on or in a target, actuator, or other location to win a prize. In yet other embodiments, the prize selecting device 101 can be configured to drop onto a button, actuator, or other target to cause a prize to be issued from the vending machine 100. Accordingly, those of ordinary skill in the art will appreciate that use of the visual targeting system 130 disclosed herein is not limited to use with a claw device, but can be used with a wide range of other skill game devices as well.

Movement of the joystick in a given direction causes the claw 110 to move in a corresponding direction. In the illustrated embodiment, the claw 110 includes a plurality of pivotable prongs 112 (identified individually as prongs 112*a-c*). Depressing an actuator or button 122 on the joystick 120 causes the claw 110 to drop. When downward motion of the claw 110 stops, the prongs 112 automatically close on one or more of the prizes 102 in its path.

In the illustrated embodiment, the visual targeting system 130 includes a light source (e.g., a laser) that is attached to the claw 110. The light source projects an image 132 onto the particular prize 102 positioned directly beneath the claw 110. In this manner, the image 132 provides a visual aid that helps the player (not shown) to accurately position the claw 110 before releasing it onto the desired prize 102.

In another aspect of this embodiment, the vending machine 100 further includes one or more coin slots 106 and a bill acceptor 108. Both of these monetary input devices are operably connected to a vending machine controller 140 (e.g., a central processing unit; shown schematically) positioned within the vending machine 100. The machine controller 140 can receive power via a cord plugged into a standard facility outlet (not shown). In addition, the vending machine 100 can also include one or more batteries to provide back-up power in the event that facility power becomes temporarily unavailable. The machine controller 140 controls the operating functions of the vending machine 100. For example, when the monetary input devices receive enough money for one play, the controller 140 responds by activating the joy stick 120 and the claw 110 for one play.

To operate the vending machine 100, a player begins by inserting the required funds into the coin slots 106 and/or the bill acceptor 108. Upon receiving payment, the machine controller 140 confirms payment and activates the joystick 120. At this time, the machine controller 140 can also activate the visual targeting system 130 to illuminate the image 132. Alternatively, the visual targeting system 130 can remain on at all times. Next, the player operates the joystick 120 to position the claw 110 over a desired prize 102. As described above, the image 132 can assist the player in aligning the claw 110 with the desired prize 102. For example, if the image 132 is positioned to the left of the desired prize 102, the player can move the claw 110 to the right until the target is centered on the prize. Once the claw 110 is in position, the player depresses the button 122 to release the claw 110. If the player has skillfully positioned the claw over the desired prize 102, then the claw will descend onto the prize and close. After closing, the claw 110 automatically retracts upwardly, moves into position above an outlet chute 116, and opens. If the claw 110 was holding a prize, the prize drops into the outlet chute 116 and is retrieved by the player via an access door 118.

The visual alignment system 130 described above adds an element of precision to the game that enhances players' enjoyment by increasing the chance of winning a prize. Increasing the chance of winning a prize may contradict conventional marketing strategies that strive to vend as few prizes as possible in order to make higher profits. However, the inventors have found that increasing the chances of winning can actually increase profits by encouraging repeated play.

Figure 2:
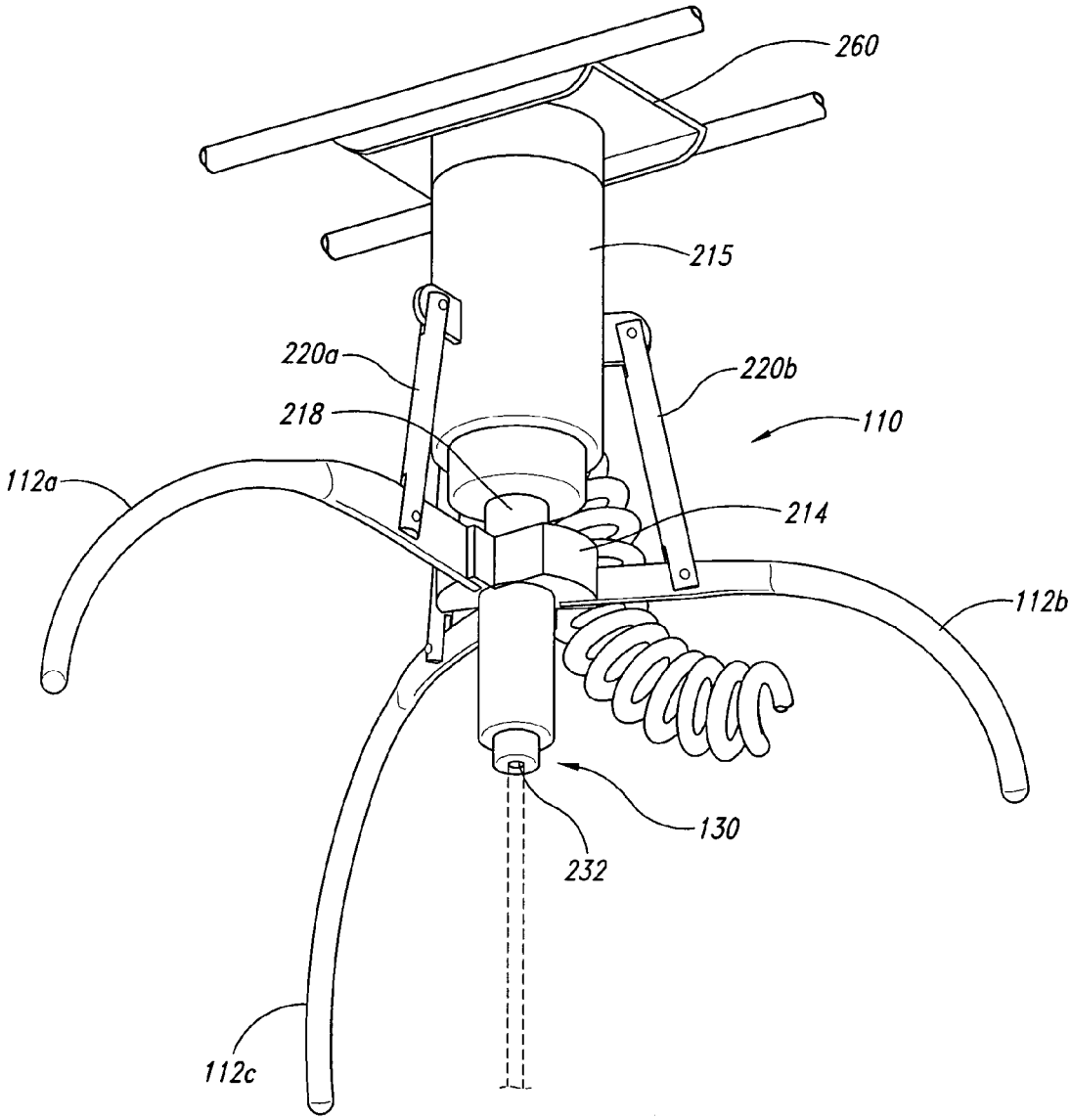
FIG. 2 is an enlarged isometric view of a pick-up device targeting system configured in accordance with an embodiment of the invention.

FIG. 2 is an enlarged isometric view of the claw 110 of FIG. 1. As this view illustrates, each of the prongs 112 is pivotally attached to a collar 214. The collar 214 is carried on a shaft 218 that is operably coupled to a solenoid (not shown) held in a housing 215. When the claw 110 is released, it descends until striking a toy or other object in its path. When the line attached to the claw 110 goes slack from impact, a switch causes the solenoid to draw the shaft 218 into the housing 215, thereby causing the collar 214 to move upwardly toward the housing 215. As the collar 214 moves upwardly, a plurality of links 220 (identified individually as links 220*a-c*) cause the prongs 112 to close. In other embodiments, air, hydraulics and/or other systems can be used to activate the claw 110 instead of a solenoid.

In the illustrated embodiment, the visual targeting system 130 includes a laser diode 232 (e.g., a "can type" laser diode) carried on a bottom end portion of a central hub 216 that extends downwardly from the collar 214. In one embodiment, the laser diode 232 can include a class II or class IIIA laser diode module having the following performance characteristics:

Wave length: 635 nm/650 nm;
Polarization: linear 100:1 typical;
Maximum ambient temperature: 400 C. (1040 F.);
Operating voltage: 2.8 Vdc to 4.0 Vdc;
Operating current: 50-65 mA;
Beam divergence: <1.3 mRad; and
Output power: 3.5 to 4.0 mW (class IIIa).

In other embodiments, the visual targeting system 130 can utilize other laser diodes and other light sources having other performance characteristics.

In the illustrated embodiment, the laser diode 232 can receive power from a vending machine power supply (e.g., a 5V, 12V DC, or normal AC power supply) power supply; not shown) that is stepped down and/or phased to slightly under 4V. Depending on various factors, such as the available outputs of a main logic board (also not shown) of the vending machine 100, the laser diode 232 can be configured to be permanently on, or can be configured to be turned on once the vending machine 100 receives the requisite amount of monetary input for a play. This latter option may be preferable because it can greatly extend the life of the laser diode 232 by having it off when not in use.

The laser diode 232 can be selected to project a number of different colors of light including green, bright red, or blue light depending on the particular application. In one embodiment, for example, a red light target may be advantageous. In other embodiments (e.g., in situations with ambient lighting) green light may provide a favorable target.

In other embodiments, the visual targeting system 130 can utilize other types of light sources (e.g., any source of electromagnetic radiation in the range from infrared to ultraviolet), whether laser-based or not, for indicating the position of the claw 110 relative to a desired prize in the playing field. These other light sources may be particularly advantageous when used with dim lighting in the playing field. However, the inherent diffusion of such light may unfavorably result in a blurred pattern on the toys that has less definition than the pattern provided by a laser-based light source.

In other embodiments, the laser diode 232 can be mounted to the side of the claw 110. Carrying the laser diode 232 to the side of the claw 110, however, may be less desirable because of difficulties associated with aligning the laser. Further, this position could upset the balance of the claw 110, leading to inferior machine play. In still further embodiments, the visual targeting system 110 can be operably coupled to the claw but not carried by the claw 110. For example, in another embodiment, the visual targeting system 130 can be carried by an adjacent portion of a carriage apparatus 260 that moves the claw 110 within the enclosure 104 (FIG. 1). In yet other embodiments, the laser diode 232 can be mounted to other locations in the enclosure 104.

Figure 3:
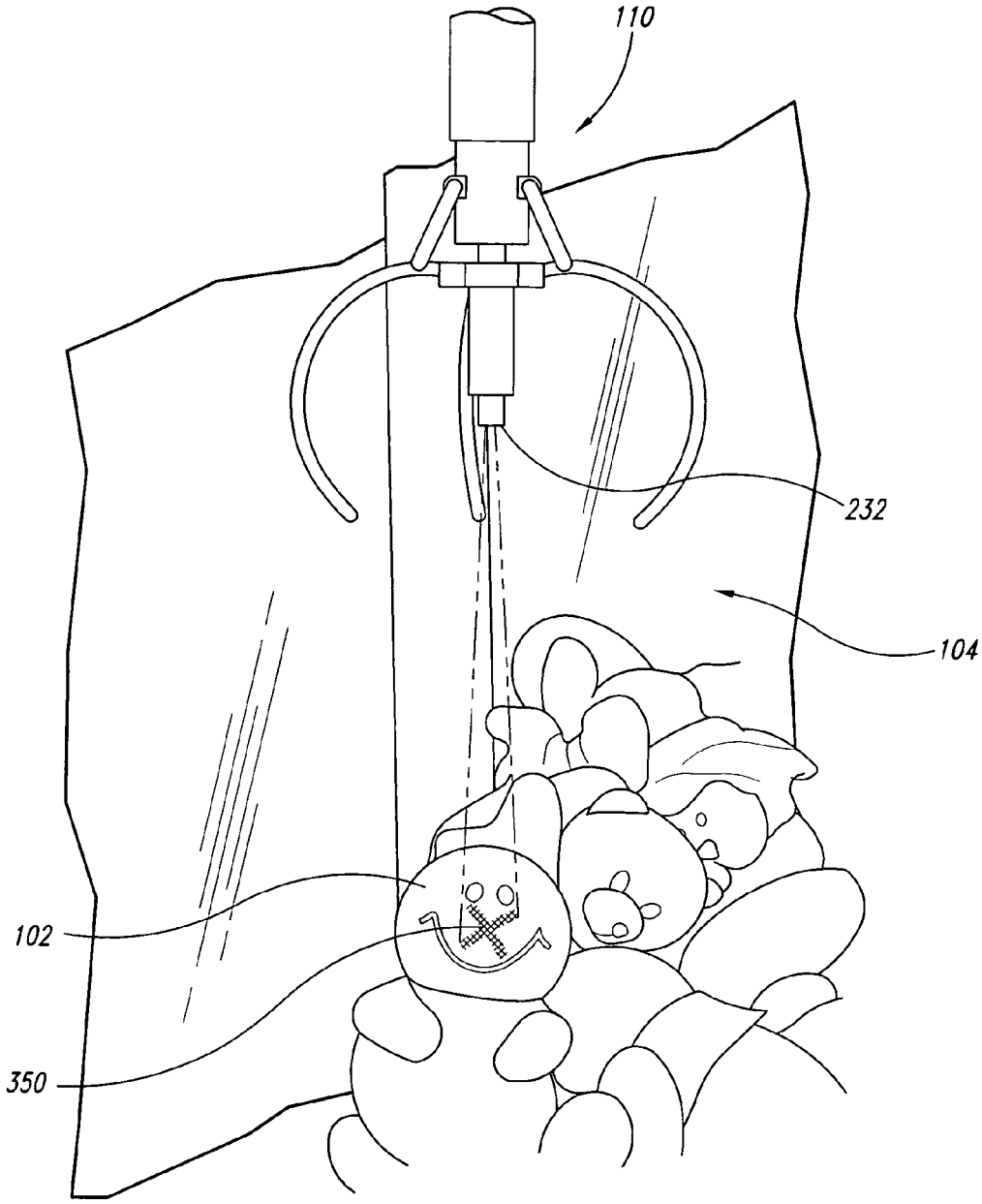
FIG. 3 is an enlarged isometric view of a portion of the amusement vending machine of FIG. 1 showing a prize with a target projected on it by the visual targeting system of FIG. 2.

FIG. 3 is an enlarged isometric view of a portion of the vending machine 100 of FIG. 1, illustrating a visual target 350 (e.g., cross-hairs) on a desired prize 102. In this embodiment, the placement of the visual target 350 indicates the vertical alignment of the claw 110 relative to the desired toy. Although the visual target 350 in the illustrated embodiment includes cross-hairs, in other embodiments, other forms of visual target can be used without departing from the spirit or scope of the present invention. For example, various lenses can be used with the laser diode 232 to make a bull's eye, heart, dot, or other shape appear on the desired prize.

Although various embodiments of the invention have been described above in the context of visual targeting systems the provide a visual target (e.g., a light image) on a prize, other embodiments of the invention can include a camera that provides the player with a view of the target from the perspective of the prize selecting device. For example, with reference to FIG. 2, in one embodiment the laser diode 232 can be replaced with a small camera that aims downwardly at the playing field. The camera can be operatively connected to a small viewing screen or other display that shows the camera view to the player. The camera view can include cross-hairs or other reference features (similar to, for example, the scope on a rifle) to assist the player in aligning the claw 110 (or other type of prize selecting device) with the desired prize. The cameral could be powered-on at all times as an enticement for passersby to play the game, or it could be configured to become active only upon receipt of sufficient funds. In further embodiments, other devices (e.g., sonar, radar, or similar locating devices) can be used to give the player an indication of the relative position of the prize selecting device (be it a claw, dropping device, etc.) relative to the desired prize.

Figure 4A:
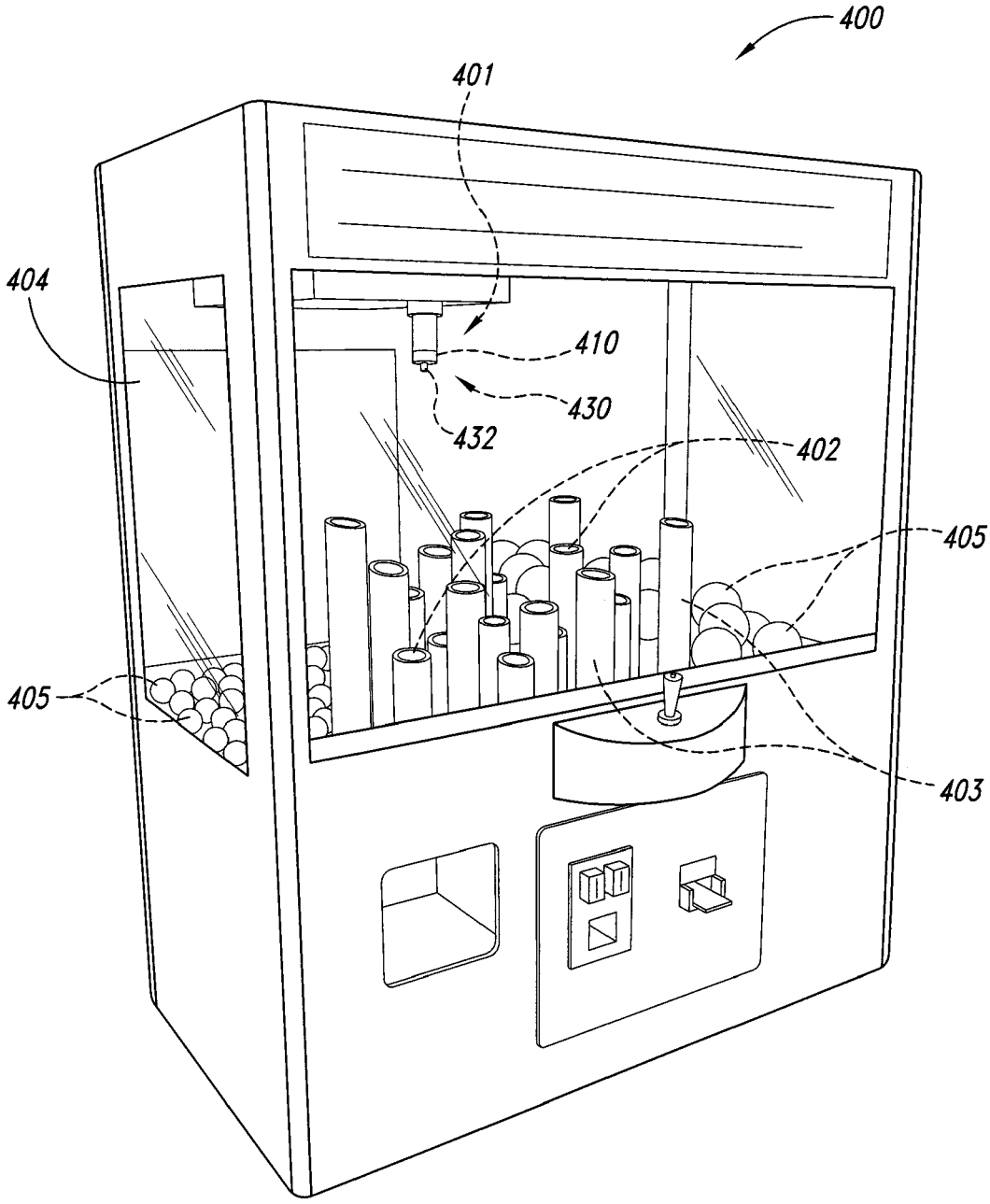
FIGS. 4A and 4B are isometric views of an amusement vending machine configured in accordance with another embodiment of the invention.
Figure 4B:
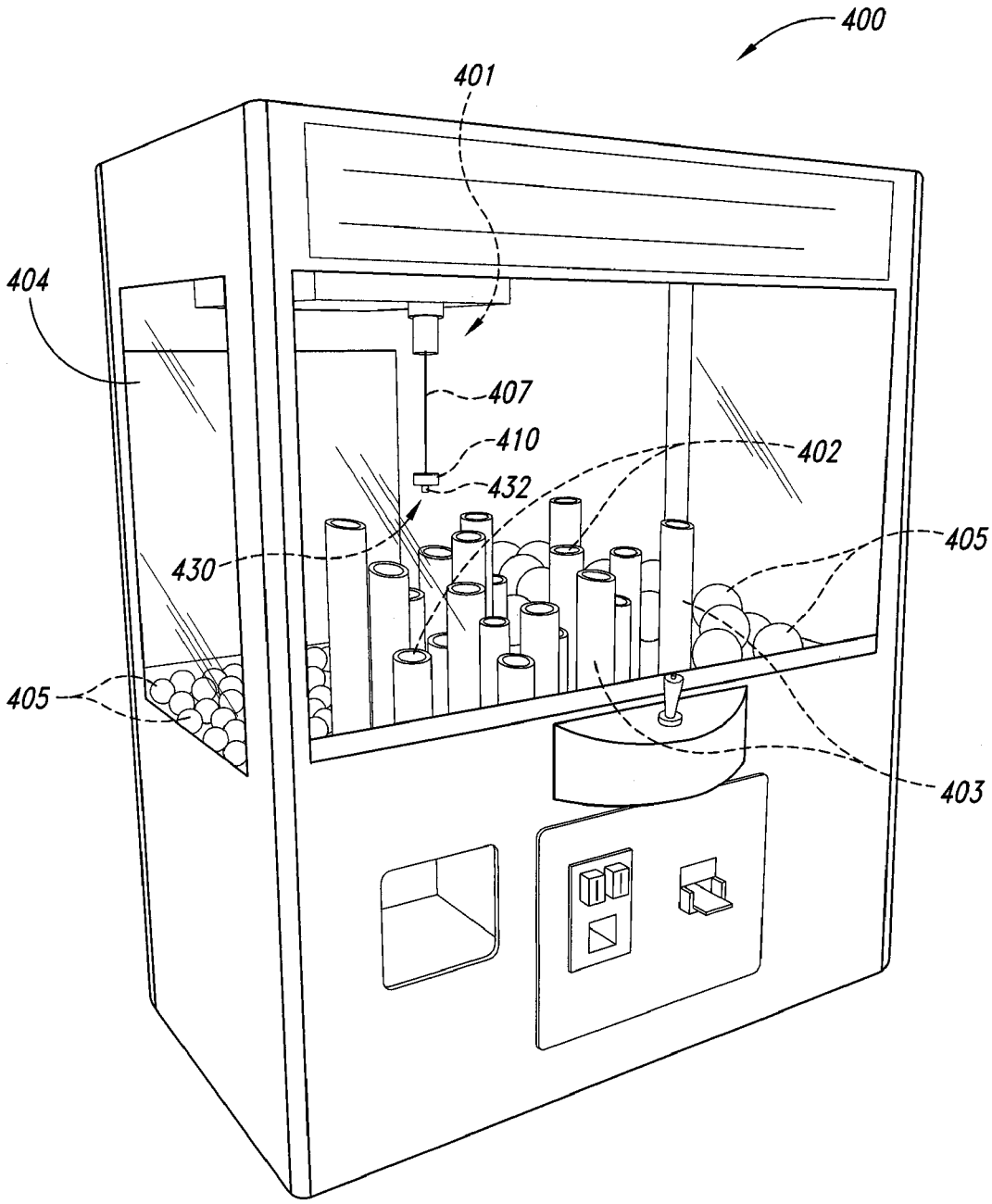

As mentioned above in the discussion of FIG. 1, in other embodiments the prize selecting device 101 can be configured to release "pucks" or other items that are dropped on or in a target, actuator, or other location to win a prize. FIGS. 4A and 4B, for example, are isometric views of an amusement vending machine 400 ("vending machine 400") configured in accordance with just such an embodiment. Referring to FIGS. 4A and 4B together, many aspects of the vending machine 400 are at least generally similar in structure and function to corresponding aspects of the vending machine 100 described in detail above. In one aspect of this particular embodiment, however, the vending machine 400 includes a prize selecting device 401 that releases an object (e.g., a "puck" 410) toward an arrangement of targets 402 in an enclosure 404. In the illustrated embodiment, the targets 402 are openings in the tops of a plurality of corresponding tubes 403. When the player successfully drops the puck 410 into one of the tubes, the puck 410 can trip a sensor or switch that causes the vending machine 400 to dispense a prize 405. In one embodiment, the puck 410 can be attached to a cord 407 (FIG. 4B) that automatically retracts the puck upwardly toward the prize selecting device 401 after each drop.

In one aspect of this embodiment, the vending machine 400 can further include a visual targeting system 430 that is at least generally similar in structure and function to the visual targeting system 130 described above with reference to FIGS. 1-3. For example, the visual targeting system 430 can include a laser diode 432 or other device that projects a visual image downwardly from the prize selecting device 401 to assist the player in positioning the device relative to the desired tube opening. In addition or alternatively, the visual targeting system 430 can include a camera that displays and image of the view downwardly from the prize selecting device 401. While the targets 402 in the illustrated embodiment are tube openings, the present invention is not limited to such targets, and can accordingly include other openings, locations, actuators, buttons and the like without departing from the spirit or scope of the present invention.

In further embodiments of the invention similar to those described above, amusement vending machines can include prize selecting devices that are dropped onto or toward a desired target or actuator to win a prize by striking the target. In these embodiments, the prize selecting device is retracted upwardly after the player has made a prize-winning attempt so that the player, or subsequent players, can try again. In these embodiments, visual targeting systems as described above (e.g., visual targeting systems using lasers and other light sources, sonar, cameras, etc.) can be used to assist the player in aiming the prize selecting device.

While many of the embodiments described above include prizes comprised of stuffed toys, jewelry, capsulated items, etc., the present invention is not limited to such prizes, and instead extends to all manner of retrievable object. In one other embodiment, for example, the see-through enclosure 104 can be at least partially filled with water to affect the trajectory of the prize selecting device and add an additional challenge to the skill game. In a related embodiment (found, perhaps, in a restaurant), the water-filled enclosure can hold one or more live prizes (e.g., lobsters, crabs, etc.), and the player can attempt to grab or otherwise win one of these prizes for subsequent consumption.

From the foregoing, it will be appreciated that specific embodiments of the invention have been described herein for purposes of illustration, but that various modifications may be made without deviating from the spirit and scope of the invention. For example, aspects of the invention described in the context of particular embodiments may be combined or eliminated in other embodiments. Further, while advantages associated with certain embodiments of the invention have been described in the context of those embodiments, other embodiments may also exhibit such advantages, and no embodiment need necessarily exhibit such advantages to fall within the scope of the invention. Accordingly, the invention is not limited, except as by the appended claims.

We claim:

1. An amusement vending machine comprising:

an enclosure having a transparent portion;

at least one prize positioned within the enclosure, wherein the at least one prize is visible from outside the enclosure through the transparent portion;

a user-operable prize selecting device movably positioned within the enclosure; and a laser operably coupled to the prize selecting device, wherein the laser provides a visual indication of the position of the prize selecting device relative to at least one prize and a target associated with the prize.

2. The amusement vending machine of claim 1 wherein the laser provides a visual indication of the vertical alignment of the prize selecting device relative to the target.

3. The amusement vending machine of claim 1 wherein the laser projects an image onto the target to provide a visual indication of the alignment of the prize selecting device relative to the target.

4. The amusement vending machine of claim 1 wherein the prize selecting device includes a retractable cord operably coupled to the object, and wherein prize selecting device is configured to retract the object after releasing the object onto the target.

5. The amusement vending machine of claim 1 wherein the object is a puck that is configured to drop and strike the target to win the at least one prize.

6. The amusement vending machine of claim 1 wherein the vending machine further comprises a user-operable controller positioned proximate to the enclosure and operably connected to the prize selecting device, wherein selective movement of the controller causes corresponding motion of the prize selecting device.

7. The amusement vending machine of claim 1 wherein the prize selecting device includes a releasing device, and wherein the vending machine further comprises:

a user-operable controller positioned proximate to the enclosure and operably connected to the releasing device, wherein selective movement of the controller causes corresponding motion of the releasing device; and a switch carried by the controller and operably connected to the releasing device, wherein manipulation of the switch causes the releasing device to execute an object releasing maneuver.

8. The amusement vending machine of claim 1 wherein the laser is carried by the prize selecting device.

9. The amusement vending machine of claim 1, further comprising at least one tube positioned in the enclosure, wherein the target is an opening in an upper portion of the tube.

10. The amusement vending machine of claim 1, further comprising a money input region, wherein the laser is activated in response to receiving monetary input via the money input region.

11. The amusement vending machine of claim 1 wherein the target is an actuator that causes the at least one prize to be dispensed when the object contacts the actuator.

12. The amusement vending machine of claim 1 wherein the laser is mounted to the prize selecting device, and wherein the amusement vending machine further comprises:

a joystick positioned proximate to the enclosure and operably connected to the prize selecting device, wherein movement of the controller in one direction causes corresponding motion of the prize selecting device in the same direction; and a button positioned on the joystick, wherein depressing the button causes the prize selecting device to drop the object at least generally toward the target.

13. An amusement machine comprising:

an enclosure;

at least one prize;

a movable prize selecting device positioned within the enclosure;

a user-operable controller positioned proximate to the enclosure and operably connected to the prize selecting device, wherein selective operation of the controller causes the prize selecting device to move within the enclosure and perform a prize selection maneuver including dropping an object toward a target associated with the prize; and a visual targeting system operably coupled to the prize selecting device, wherein the visual targeting system provides an indication of the position of the prize selecting device relative to at least one prize and a target associated with the prize.

14. The amusement machine of claim 13 wherein the target is an opening of a tube positioned in the enclosure.

15. The amusement machine of claim 13 wherein the target is an actuator that causes the at least one prize to be dispensed.

16. The amusement machine of claim 13 wherein the visual targeting system provides a visual indication of the vertical alignment of the prize selecting device relative to at least one prize and the target associated with the prize prior to the prize selection maneuver.

17. The amusement machine of claim 13 wherein the visual targeting system includes a light source that provides a visual indication of the alignment of the prize selecting device relative to at least one prize and the target associated with the prize prior to the prize selection maneuver.

18. The amusement machine of claim 13 wherein the visual targeting system includes a laser that provides a visual indication of the alignment of the prize selecting device relative to at least one prize and the target associated with the prize prior to the prize selection maneuver.

19. The amusement machine of claim 13 wherein the visual targeting system includes a laser that projects an image onto the target associated with the prize to provide a visual indication of the alignment of the prize selecting device relative to the at least one prize and the target associated with the prize prior to the prize selection maneuver.

20. The amusement machine of claim 13, further comprising a money input region, wherein the user-operable controller is activated in response to monetary input via the money input region.

21. The amusement machine of claim 13 wherein the visual targeting system includes a camera that provides an indication of the position of the prize selecting device relative to at least one prize and the target associated with the prize.

22. The amusement machine of claim 13 wherein the prize selection device includes a retractable cord operably coupled to the object, and wherein the prize selection device is configured to retract the object after performing the prize selection maneuver.

23. A skill crane game comprising:

an enclosure;

at least one target positioned within the enclosure;

means for releasing an object within the enclosure toward the target, wherein the means for releasing are remotely operable by a player positioned outside the enclosure; and means for providing a visual indication of the position of the means for releasing relative to the at least one target.

24. The skill crane game of claim 23 wherein the means for providing a visual indication include a light source.

25. The skill crane game of claim 23 wherein the means for providing a visual indication include a laser light source.

26. The skill crane game of claim 23 wherein the means for releasing include a retractable cord operably coupled to the object.

* * * * *